US011691810B1

(12) United States Patent
Issa

(10) Patent No.: US 11,691,810 B1
(45) Date of Patent: Jul. 4, 2023

(54) BIN BAG DISPENSER

(71) Applicant: Abdullah Issa, Melbourne (AU)

(72) Inventor: Abdullah Issa, Melbourne (AU)

( * ) Notice: Subject to any disclaimer, the term of this patent is extended or adjusted under 35 U.S.C. 154(b) by 0 days.

(21) Appl. No.: 17/725,302

(22) Filed: Apr. 20, 2022

Related U.S. Application Data

(63) Continuation of application No. 17/555,864, filed on Dec. 20, 2021, now Pat. No. 11,453,549.

(51) Int. Cl.
*B65F 1/06* (2006.01)
*B65D 33/00* (2006.01)
*B65D 83/08* (2006.01)

(52) U.S. Cl.
CPC ..... *B65F 1/062* (2013.01); *B65D 33/002* (2013.01); *B65D 83/0805* (2013.01)

(58) Field of Classification Search
CPC ..... B65F 1/062; B65F 1/068; B65F 1/1607; B65F 1/067; B65F 1/0006; B65D 83/0805; B65D 33/002
USPC ..... 220/495.07, 908, 495.11, 908.1; 206/390, 554, 494, 395
See application file for complete search history.

(56) References Cited

U.S. PATENT DOCUMENTS 5,322,180 A 6/1994 Ker
5,353,950 A 10/1994 Taylor et al.
5,405,041 A * 4/1995 Van Brackle ..... B65F 1/062 220/495.07
5,678,723 A 10/1997 Swift et al.
6,193,095 B1 * 2/2001 McNeil ..... B65F 1/062 220/495.07
6,199,714 B1 3/2001 Thompson
6,283,405 B1 9/2001 Tracy
7,168,591 B1 1/2007 Miller
8,522,999 B2 9/2013 Licata
8,807,379 B1 8/2014 Hammond
9,771,215 B2 9/2017 Rogers
10,329,115 B2 6/2019 Licata
10,889,434 B2 1/2021 Mandelbaum
2005/0029281 A1 2/2005 Westermann et al.
2005/0092753 A1 5/2005 Best
2008/0083757 A1 4/2008 Parker et al.
2009/0302041 A1 12/2009 Wolfson et al.
2010/0276428 A1 11/2010 Lord et al.
2015/0321841 A1 11/2015 Salas et al.
2015/0375920 A1 12/2015 Hammond
2017/0197782 A1 7/2017 Reith
2018/0044108 A1 2/2018 Ackerman

* cited by examiner

*Primary Examiner* — King M Chu
(74) *Attorney, Agent, or Firm* — Eric Karich; Karich & Associates

(57) ABSTRACT

A bin bag dispenser has a dispenser housing having a housing base and a housing wall that extends upwardly to form a chamber for holding a trash bag roll. A housing cover fits over the dispenser housing to cover the chamber. The housing cover has a dispensing mechanism for dispensing trash bags from the trash bag roll. A fastener is provided for removably fastening the dispenser housing to a bottom of the trash bin, the fastener including a plurality of attachment receivers formed on the housing base, and a plurality of feet adapted to removably attach to the plurality of attachment receivers, each of the plurality of feet having a top end and a bottom end, and a bin fastener for fastening the dispenser to the trash bin.

7 Claims, 7 Drawing Sheets

BIN BAG DISPENSER

CROSS-REFERENCE TO RELATED APPLICATIONS

This application for a utility patent is a continuation-in-part of a previously filed utility patent, currently pending, having the application Ser. No. 17/555,864, filed Dec. 20, 2021.

BACKGROUND OF THE INVENTION

Field of the Invention

This invention relates generally to dispensers, and more particularly to a dispenser for dispensing bin bags.

Description of Related Art

The prior art teaches various forms of dispensers for dispensing bin bags (a.k.a. trash bags). Some examples include the following:

Miller, U.S. Pat. No. 7,168,591, teaches a trash bag dispenser that includes a housing for containing trash bags, and a cover having a slot therein for guiding the trash bag therethrough. The cover is movably connected to the housing and integral therewith for allowing the cover to capture the trash bag and to allow the trash bag to freely move when urged through the slot. The trash bag dispenser is attachable to an interior of the trash receptacle with an adhesive backed hook and loop type fastener.

Similar devices are also shown in Licata, U.S. Pat. No. 8,522,999, Tracy, U.S. Pat. No. 6,283,405, and Thompson, U.S. Pat. No. 6,199,714.

The prior art teaches dispensers for dispensing bin bags. However, the prior art does not teach a bin bag dispenser having the improvements described herein. The present invention fulfills these needs and provides further advantages as described in the following summary.

SUMMARY OF THE INVENTION

The present invention teaches certain benefits in construction and use which give rise to the objectives described below.

The present invention provides a bin bag dispenser for holding a trash bag roll on a bottom of a trash bin. The bin bag dispenser includes a dispenser housing having a housing base and a housing wall that extends upwardly from the housing base to form a chamber for holding the trash bag roll. Aa housing cover fits over the dispenser housing to cover the chamber. A dispensing mechanism is provided in the housing cover for dispensing trash bags from the trash bag roll. The dispenser further includes a fastener for removably fastening the dispenser housing to a bottom of the trash bin. The fastener has a plurality of receivers extending from the dispenser housing, and a plurality of feet adapted to removably attach to the plurality of receivers, each of the plurality of feet having a top end and a bottom end, and further having a means for securing each bottom end to the bottom of the trash bin.

A primary objective of the present invention is to provide a bin bag dispenser having advantages not taught by the prior art.

Another objective is to provide a bin bag dispenser that may be easily and securely mounted in the bottom of the trash bin for dispensing bin bags for use in the trash bin.

Another objective is to provide a bin bag dispenser that may be adjustably mounted in the bottom of the trash bin at different heights.

A further objective is to provide a bin bag dispenser that may easily dispense bin bags at the point of use, so they are always conveniently placed.

A further objective is to provide a bin bag dispenser that facilitates reordering of bin bags.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a bin bag dispenser for holding a trash bag roll on a bottom of a trash bin.

Figure 1:
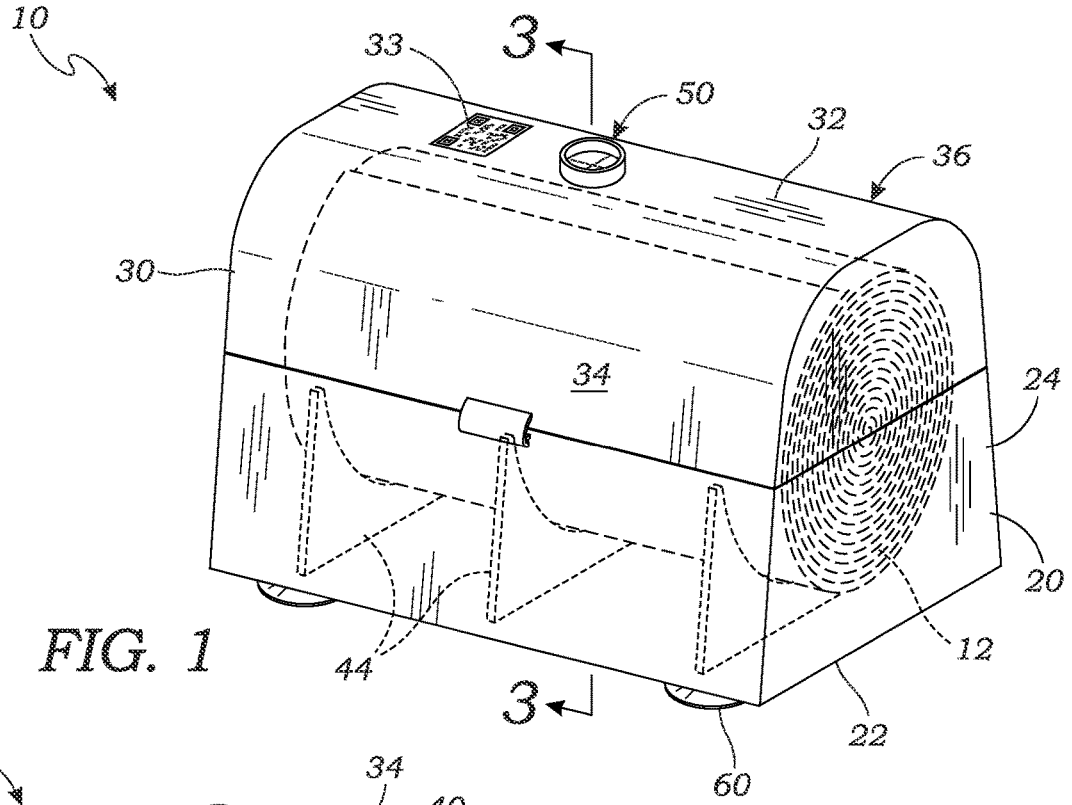
FIG. 1 is a perspective view of a bin bag dispenser according to one embodiment of the present invention, illustrating the bin bag dispenser in a closed position.
Figure 2:
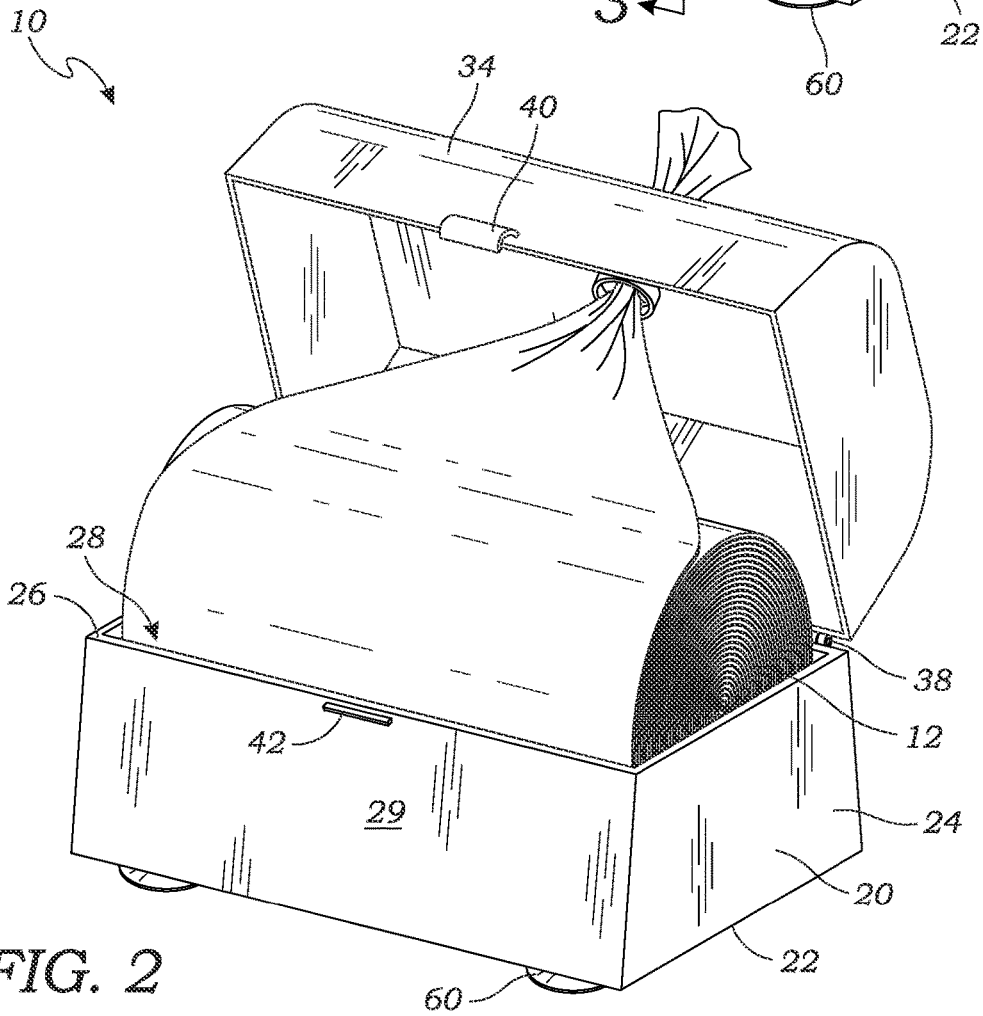
FIG. 2 is a perspective view illustrating the bin bag dispenser in an open position.
Figure 3:
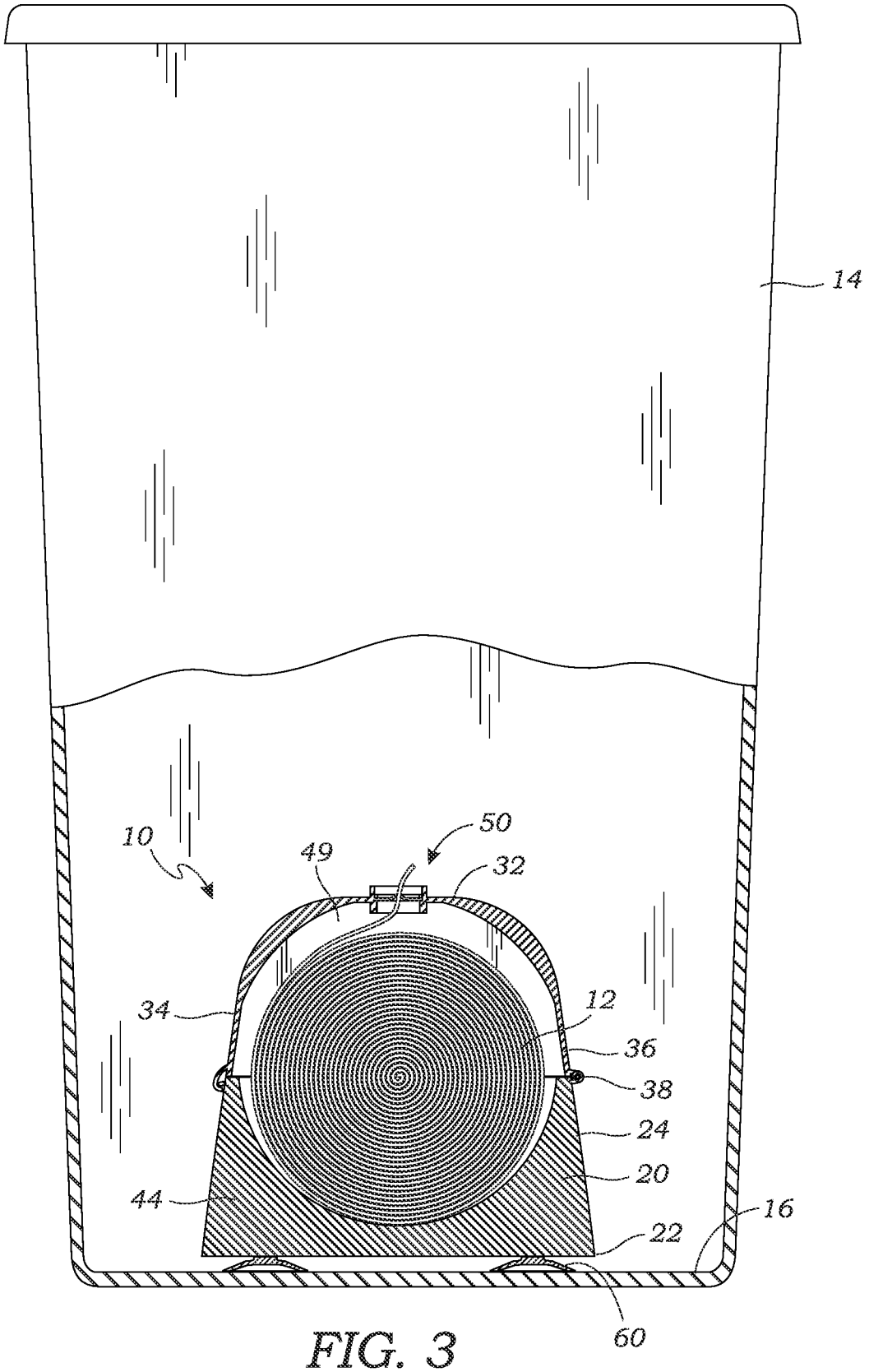
FIG. 3 is a side elevation view of the bin bag dispenser operably positioned in a trash bin, with a portion of the trash bin being broken away to illustrate the bin bag dispenser positioned within the trash bin.

FIG. 1 is a perspective view of a bin bag dispenser 10 according to one embodiment of the present invention, illustrating the bin bag dispenser 10 in a closed position. FIG. 2 is a perspective view illustrating the bin bag dispenser 10 in an open position, illustrating a trash bag roll 12 in the dispenser 10. FIG. 3 is a side elevation view of the bin bag dispenser operably positioned in a trash bin 14, with a portion of the trash bin 14 being broken away to illustrate the bin bag dispenser 10 positioned within the trash bin 14. The bin bag dispenser 10 is shown in a cross-section taken along lines 3-3 in FIG. 1. While a bottom of the trash bin 14 is illustrated as one example, the bin bag dispenser 10 may be attached to a different surface, e.g., a wall, countertop, door, shelf, etc., which should be considered within the scope of the present invention.

As shown in FIGS. 1-3, the bin bag dispenser 10 includes a dispenser housing 20 having a housing base 22 and a housing wall 24 that extends upwardly from the housing base 22 to a perimeter 26, and the base 22 and wall 24 together form a chamber 28 for holding a trash bag roll 12. In this embodiment, the housing base 22 is a generally shaped like a rectangular cuboid, although any suitable shape for holding the trash bag roll 12 may be used. In some embodiments, the dispenser housing 20 may be constructed of a biodegradable material (e.g., organic fibers as in cardboard, etc.), such that when the trash bag roll 12 has been used up, the entire bin bag dispenser 10 may be efficiently disposed of. Alternatively, the dispenser housing 20 may be constructed of a material adapted to last through multiple trash bag rolls 12, e.g., plastic, aluminum, steel, pine, bamboo, oak, etc., or any other suitable materials known in the art.

In this embodiment, the dispenser housing 20 further includes a housing cover 30 that fits over the dispenser housing 20, abutting the perimeter 26, to cover the chamber 28. In this embodiment, the housing cover 30 having a top panel 32, a front surface 34, and a rear surface 36. As shown in FIG. 1, in some embodiments, a machine-readable code 33 such as a QR code, NFC tag, barcode, etc. may be added to the dispenser housing 20. The machine-readable code 33 may be printed on or attached or otherwise associated with the dispenser housing 20. In this embodiment it is printed on the top panel 32 of the housing cover 30, although it may be located in any other suitable location. In use, the machine-readable code 33 directs the user, when captured with a portable electronic device such as a smart phone, to an electronic storefront (not shown) that may facilitate re-order of the bin bags via a smart phone or other scanning device (not shown), and/or the machine-readable code 33 may facilitate ordering other supplies/parts, etc. The storefront should automatically include the particular product information associated with that particular QR code 33, so the user does not have to remember or look up the particular size of bin bags that are required for that trash bin.

In some embodiments, the housing cover 30 may further include at least one area that is transparent so that at least some of the trash bag roll 12 is visible, and the user can easily see from the exterior whether the trash bag roll 12 is running low. In other embodiments, the entire housing cover 30 may be transparent, or this feature may be excluded from the product. Furthermore, in some embodiments, the housing cover 30 may also be provided with tags (not shown), single or multi-use, wherein the tags are attached to the housing cover 30. The tags may include insignia, which may be hand-written or pre-printed, that conveys information such as size of the trash bag roll 12, type of bag, etc. Obviously, in some implementations, the tags are not included.

A hinge 38 connects the housing cover 30 (in this case, the rear surface 36) to the dispenser housing 20. The hinge 38 enables the housing cover 30 to pivot between an open position shown in FIG. 2, and a closed position shown in FIG. 1. A latch 40 on the front surface 34 of the housing cover 30 interlocks with a receiver 42 of a front surface 29 of the dispenser housing 20 to lock the housing cover 30 in the closed position. In this embodiment, the latch 40 is in the form of a resilient hook, and the receiver 42 is in the form of a ridge, but any number of mating latch mechanisms known in the art may be used, and should be considered within the scope of the present invention.

The dispenser housing 20 may further include at least one curved rib 44. In this embodiment, the dispenser housing 20 includes a plurality of curved ribs 44, each connecting the housing base 22 and the housing wall 24, each of the plurality of curved ribs 44 having a radius of curvature that is approximately equal to a radius of curvature of the trash bag roll 12, so that the trash bag roll 12 fits snugly on the ribs 44. Similar ribs 49 may be formed in the housing cover 30 as well, as shown in FIG. 3.

Figure 4:
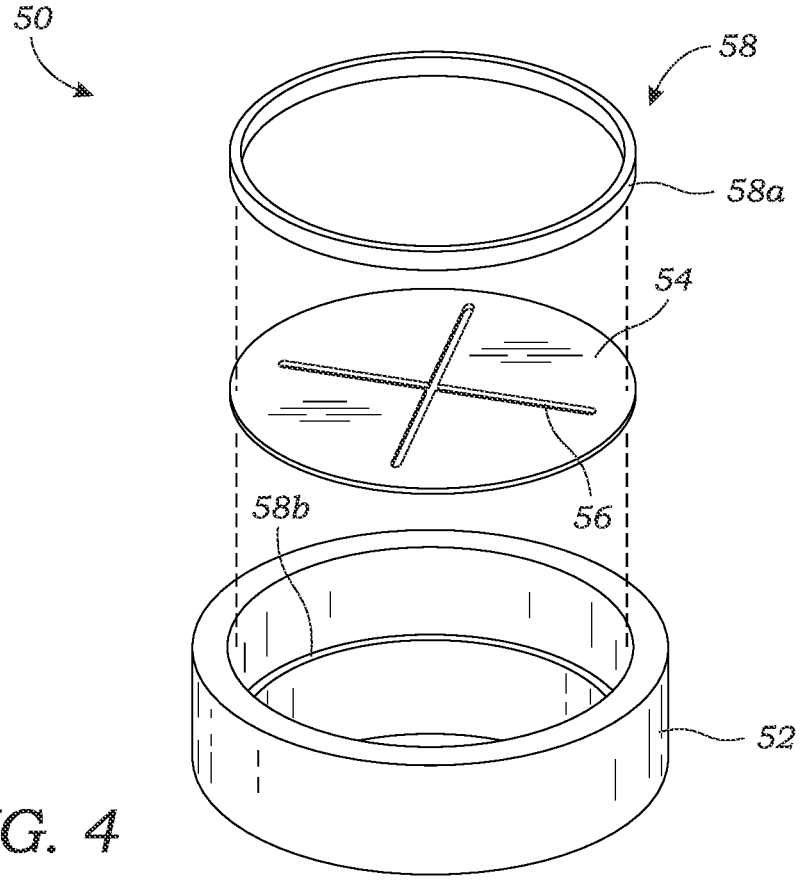
FIG. 4 is an exploded perspective view of a dispensing mechanism of the bin bag dispenser.

As shown in FIGS. 1-3, the bin bag dispenser 10 further includes a dispensing mechanism 50 mounting in the housing cover 30, in this case in the top panel 32, for dispensing individual bags from the trash bag roll 12. This is illustrated in FIG. 4, and is discussed in greater detail below. The bin bag dispenser 10 may further include a fastener 60 for removably fastening the dispenser housing 20 to a bottom 16 of the trash bin 14. In this case in the fastener 60 is in the form of a suction cup, but in alternative embodiments it may be any form of fastener known in the art, and alternative fasteners should be considered within the scope of the present invention.

FIG. 4 is an exploded perspective view of the dispensing mechanism 50 of the bin bag dispenser 10. As shown in FIG. 4, the dispensing mechanism 50 of this embodiment includes an annular retainer 52 fixedly mounted to the top panel 32 of the housing cover 30. The dispensing mechanism 50 further includes a resilient sheet 54 having a slit 56, and a means for mounting 58 the resilient sheet 54 within the annular retainer 52 so that trash bags from the trash bag roll may be dispensed though the slit 56 of the dispensing mechanism.

In this embodiment, the means for mounting 58 includes a retainer ring **58*a* that lockingly engages a step 58*b* in the annular retainer 52. The locking engagement may be achieved via a frictional locking, and or may include adhesives, heat welding, and/or any other locking mechanism known in the art. The means for mounting 58 may alternatively include any other forms of mounting known in the art, such as the use of mechanical fasteners, co-molding, wrapping the resilient sheet 54 around the annular retainer 52 and bonding or fastening the resilient sheet 54 to the retainer 52**, and/or any other mechanism known in the art.

As shown in FIGS. 1-4, in various embodiments, the dispensing mechanism 50 allows for a trash bag to be pulled upwardly through the slit 56 of the resilient sheet 54, thereby pulling up the next trash bag with it. In this manner, when changing a trash bag, the chances of removing and not replacing it are reduced.

Figure 5:
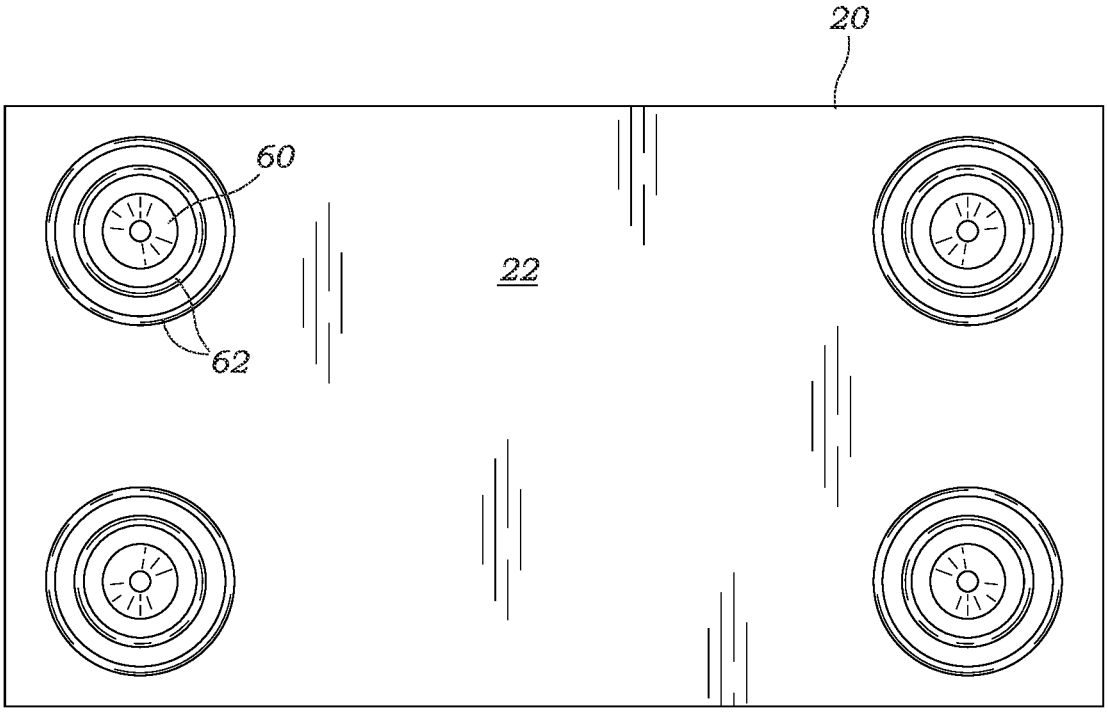
FIG. 5 is an exploded perspective view of the bin bag dispenser, showing fasteners.

FIG. 5 is a bottom plan view of the bin bag dispenser 10. As shown in FIG. 5, the bin bag dispenser 10 of this embodiment includes fasteners 60 at each corner of the housing 20. In this embodiment, each of the fasteners 60 is surrounded by a plurality of annular ridges 62 that extend upwardly from the housing base 22. In this case, there are at least two annular ridges 62 around each of the fasteners 60.

Figure 6:
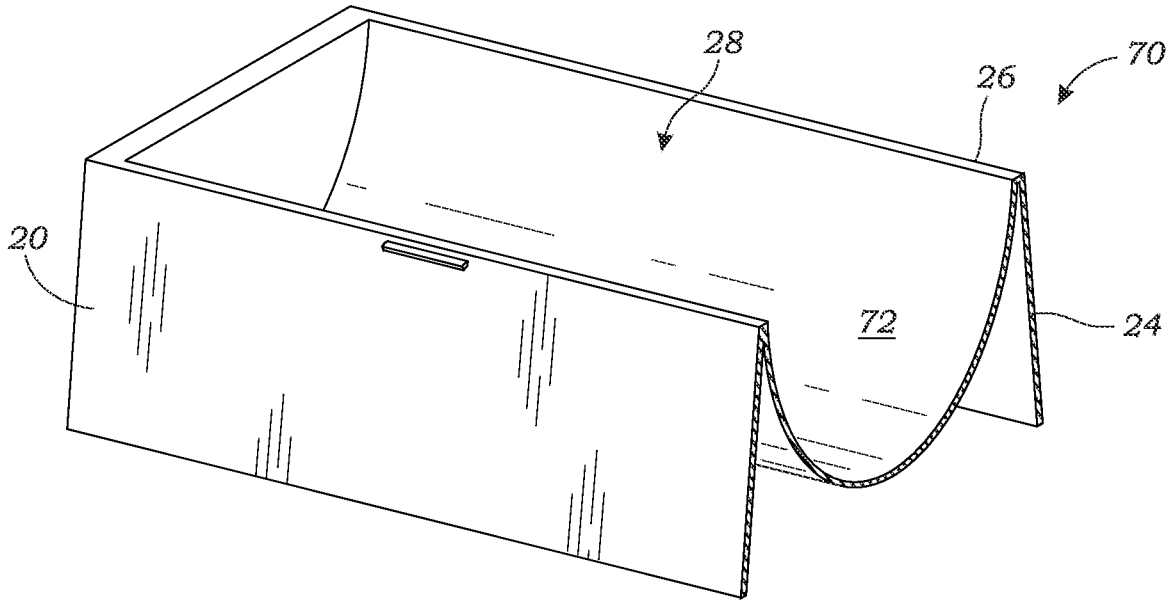
FIG. 6 is a perspective view of a second embodiment of a dispenser housing, with a side of the dispenser housing broken away to illustrate the structure of a base of the dispenser housing.

FIG. 6 is a perspective view of a second embodiment of a dispenser housing 70, with a side of the dispenser housing 70 broken away to illustrate the structure of a base of the dispenser housing 70. As shown in FIG. 6, in this embodiment the housing base 22 and the housing wall 24 form a U-shaped inner surface 72 that defines the chamber 28, and which provides the at least one rib discussed above. By extending the rib structure the entire length of the housing 70, from end to end, the roll of bin bags is more fully supported, so that the roll can rotate more easily, and so that there are no edges that might damage the roll of bags (e.g., tearing, etc.).

Figure 7:
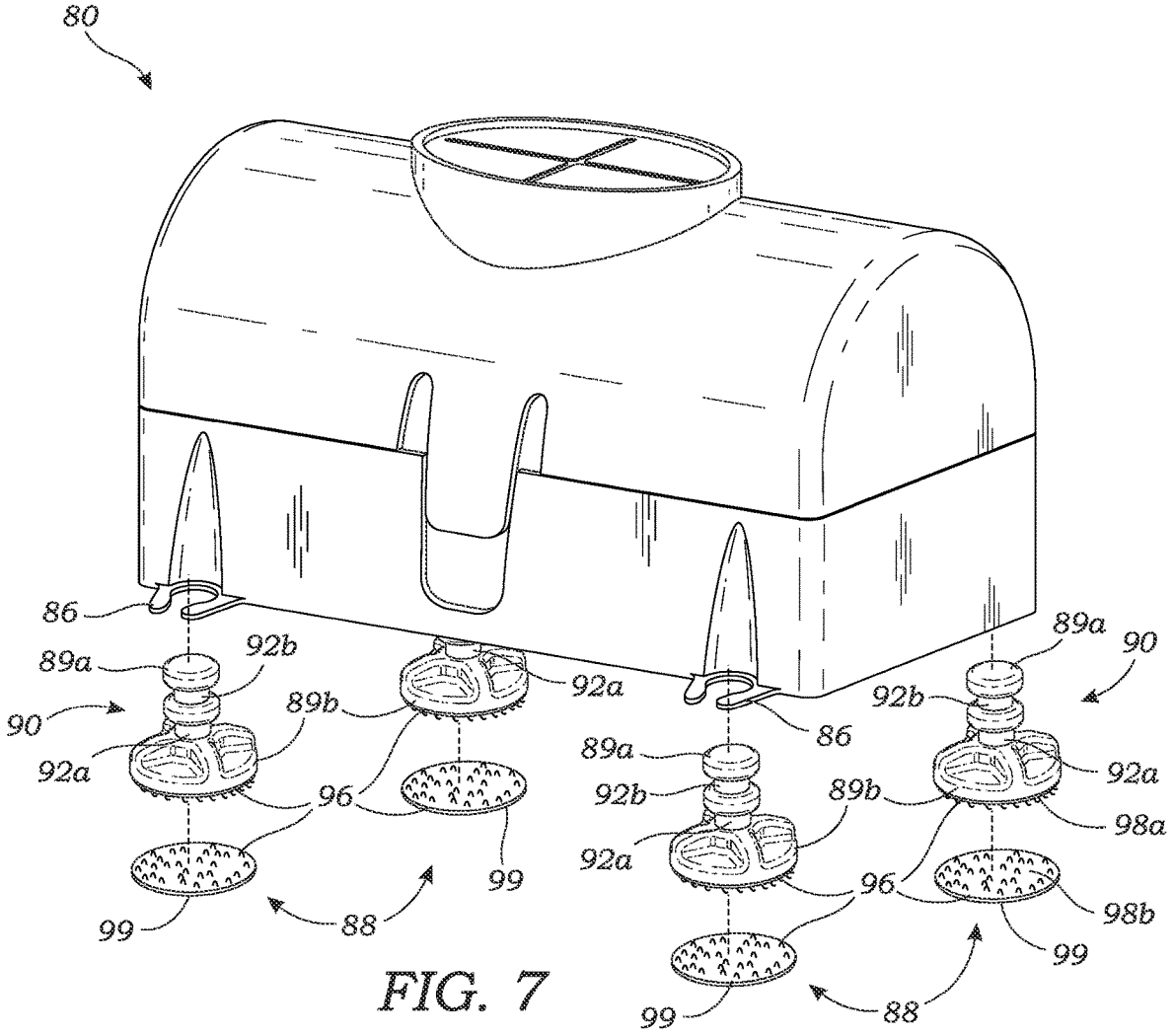
FIG. 7 is an exploded perspective view of a third embodiment of the bin bag dispenser, illustrating a plurality of feet.
Figure 8:
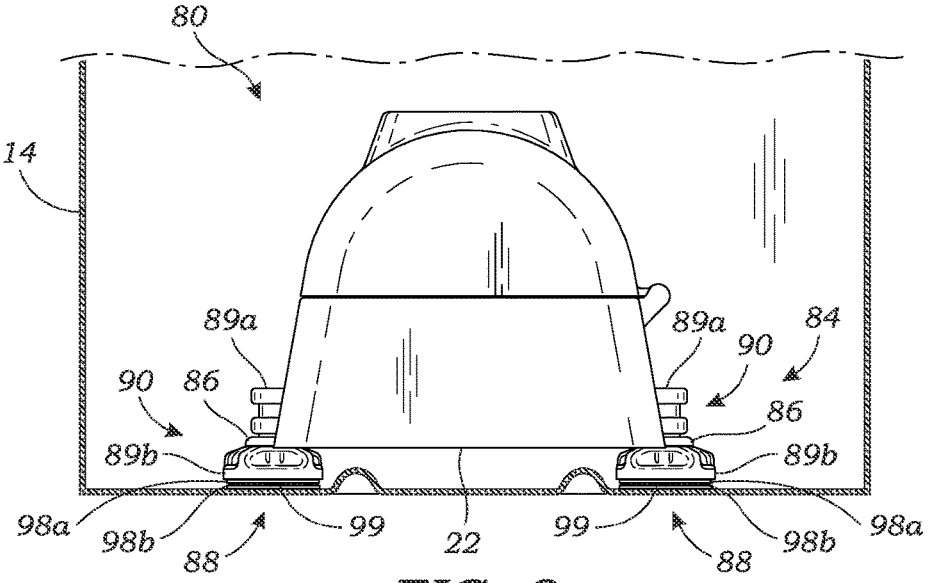
FIG. 8 is a sectional view of the trash bin with the bin bag dispenser positioned therein.

FIG. 7 is an exploded perspective view of a third embodiment of the bin bag dispenser 80, and FIG. 8 is an up close sectional view of the trash bin 14 with the bin bag dispenser 80 positioned therein. As shown in FIGS. 7-8, the bin bag dispenser 80 of this embodiment includes fasteners 84 on the dispenser housing, in this embodiment adjacent each corner of the housing. The fasteners 84 of this embodiment are in the form of a plurality of attachment receivers 86 formed in the housing base 22, and a plurality of feet 88 adapted to removably attach to the attachment receivers 86. In this embodiment, the plurality of feet 88 each have a top end 89*a* and a bottom end 89*b*, an adjustment mechanism 90 for adjusting the height of the housing base 22 relative to the bottom ends 89*b* of the plurality of feet 88, and a means for securing 96 each bottom end 89*b* to the bottom of the trash bin 14, each discussed below.

As illustrated in FIGS. 7-8, the means for securing 96 may be in the form of a first hook and loop fastener 98*a* mounted to the bottom end 89*b* of each foot 88, and a second hook and loop fastener 98*b* having an opposing adhesive side 99, such that the opposing adhesive side 99 may be attached to the bottom of the trash bin 14, and the first hook and loop fastener 98*a* may be attached to the second hook and loop fastener 98*b*. In alternative embodiments, however, the means for securing 96 may alternatively be in the form of other forms of fasteners known in the art.

In this embodiment, the adjustment mechanism 90 of the plurality of feet 88 is in the form of a lower recessed portion 92*a* and an upper recessed portion 92*b* between the top end 89*a* and the bottom end 89*b* of each of the pair of feet 88. Each recessed portion 92*a* and 92*b* is adapted to receive and frictionally engage one of the attachment receivers 86 so the plurality of feet 88 are adjustably secured to the dispenser housing 20.

In use, each of the plurality of feet 88 may be snapped into one of the arms 86 of either the lower recessed portion 92*a* or the upper recessed portion 92*b*, depending on the desired height desired between the dispenser housing and the trash bin 14. Prior to placing the dispenser 80 into the trash bin 14, the height adjustment feature 90 of the dispenser 10 may enable a scent "disc" or similar (pod, strip, etc.) to be placed beneath the housing base 22 to freshen the interior of the trash bin 14. The second hook and loop fastener 98*b* may initially be attached to the first hook and loop fastener 98*a*, and an adhesive paper (not shown) may be removed from the opposing adhesive side 99 of the second hook and loop fastener 98*b*. In this manner, when the bin bag dispenser is placed within the trash bin 14, as shown in FIG. 8, the exposed adhesive becomes stuck to the bottom of the trash bin 14. The bin bag dispenser may then be pulled from the trash bin if it is pulled with enough force to separate the first hook and loop fastener 98*a* from the second hook and loop fastener 98*b*, and replaced at will (the second hook and loop fastener 98*b* will be adhered to the proper place in the bottom of the trash bin 14).

Figure 9:
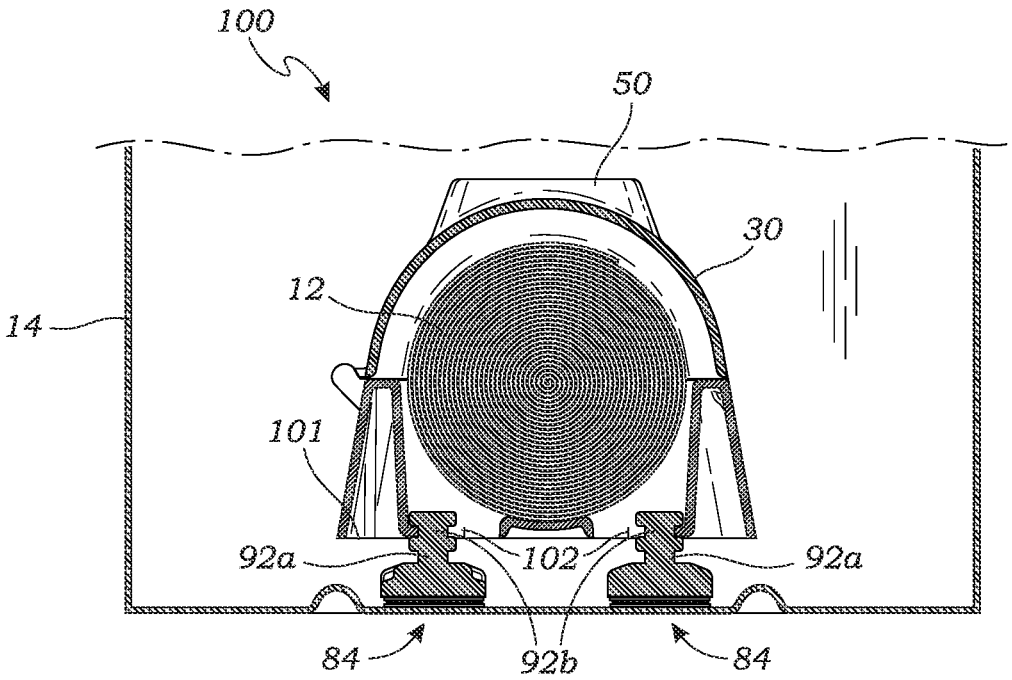
FIG. 9 is a sectional view of a fourth embodiment of the bin bag dispenser positioned within the trash bin at a first adjustment height.
Figure 10:
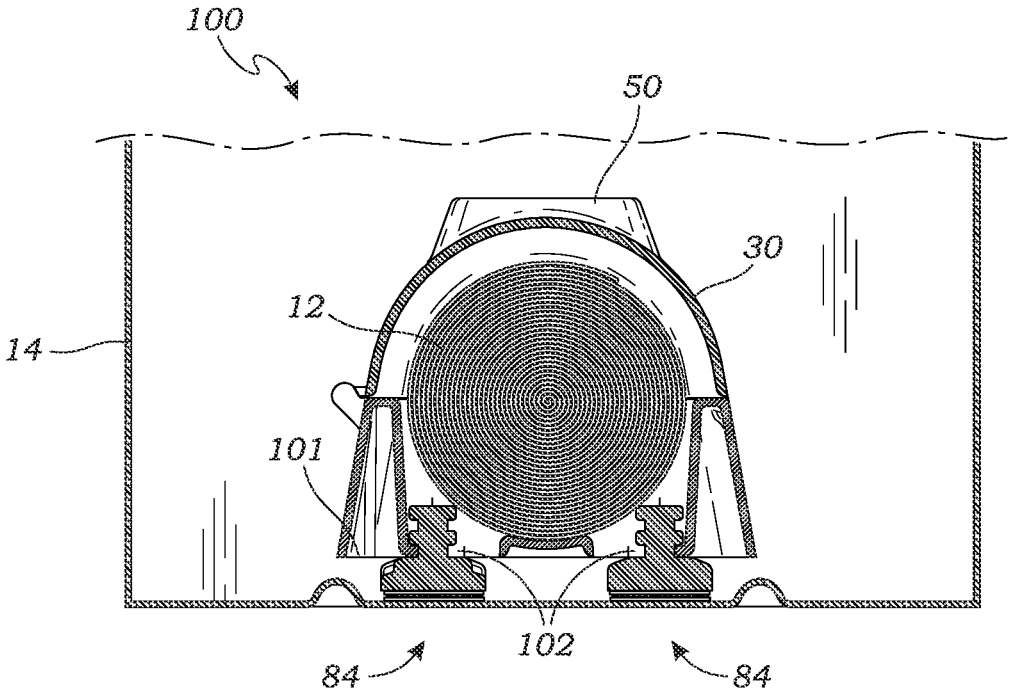
FIG. 10 is a sectional view similar to FIG. 9, shown at a second adjustment height.
Figure 11:
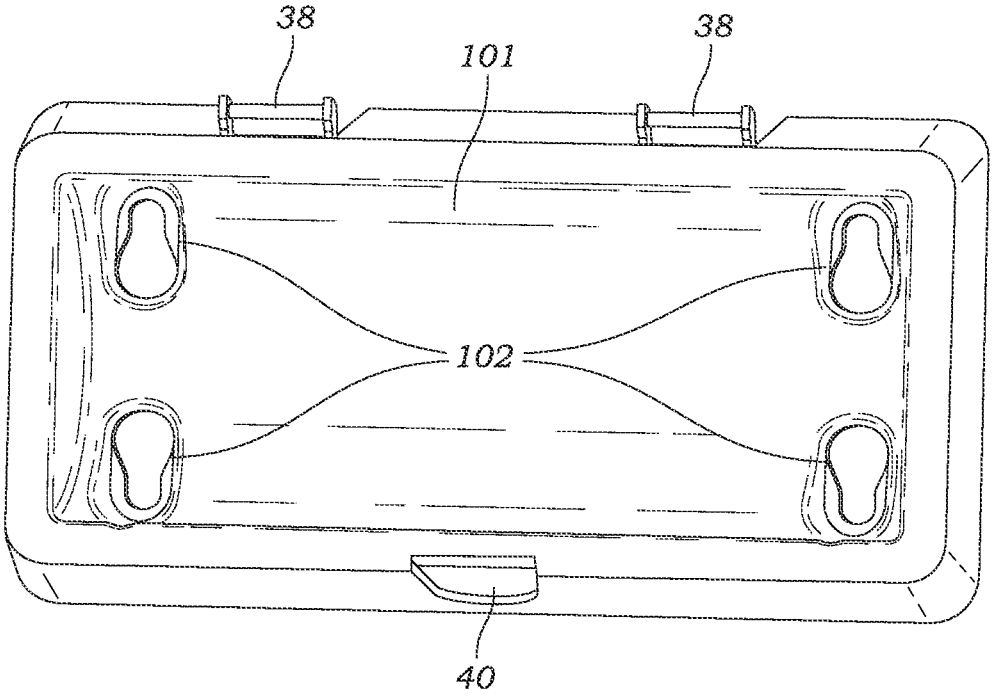
FIG. 11 is a top plan view of a base of the bin bag dispenser.

FIG. 9 is a sectional view of a fourth embodiment 100 of the bin bag dispenser positioned within the trash bin 14 at a first adjustment height, FIG. 10 is a sectional view thereof, shown at a second adjustment height, and FIG. 11 is a top plan view of a base 101 of the bin bag dispenser 100. As shown in FIGS. 9-11, the fasteners of this embodiment are in the form of a plurality of slots 102 formed in the housing base 22, and the plurality of feet 88 adapted to removably attach to the slots 102

As shown in FIG. 11, in this embodiment, the slots 102 are in the form of keyhole slots, but other desired shapes may be formed. In use, each of the plurality of feet 88 may be snapped into one of the slots 102 of either the lower recessed portion 92*a* or the upper recessed portion 92*b*, depending on the desired height desired between the dispenser housing and the trash bin 14. In some implementations, the slots 102 may also drain any liquid that may have entered into the bin bag dispenser 100.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A bin bag dispenser for holding a trash bag roll to a surface, the bin bag dispenser comprising:

a dispenser housing having a housing base and a housing wall that extends upwardly from the housing base to form a chamber for holding the trash bag roll;

a housing cover that fits over the dispenser housing to cover the chamber;

a dispensing mechanism in the housing cover for dispensing trash bags from the trash bag roll;

a fastener for removably fastening the dispenser housing to the surface, the fastener having a plurality of receivers of the housing base and a plurality of feet adapted to removably attach to the plurality of receivers, each of the plurality of feet having a top end and a bottom end, and further having a means for securing each bottom end to the surface; and further comprising an adjustment mechanism for adjusting the height of the housing base relative to the bottom ends of the plurality of feet.

2. The bin bag dispenser of claim 1, wherein the adjustment mechanism is in the form of a lower recessed portion and an upper recessed portion between the top end and the bottom end of each of the plurality of feet, each of the lower and upper recessed portions being adapted to receive and frictionally engage one of the plurality of receivers so the plurality of feet are adjustably secured to the dispenser housing.

3. A bin bag dispenser for holding a trash bag roll to a surface, the bin bag dispenser comprising:

a dispenser housing having a housing base and a housing wall that extends upwardly from the housing base to form a chamber for holding the trash bag roll;

a housing cover that fits over the dispenser housing to cover the chamber;

a dispensing mechanism in the housing cover for dispensing trash bags from the trash bag roll;

a fastener for removably fastening the dispenser housing to the surface, the fastener having a plurality of receivers of the housing base and a plurality of feet adapted to removably attach to the plurality of receivers, each of the plurality of feet having a top end and a bottom end, and further having a means for securing each bottom end to the surface; and wherein the means for securing is in the form of a first hook and loop fastener mounted to the bottom end of each foot, and a second hook and loop fastener having an opposing adhesive side, such that the opposing adhesive side may be attached to the bottom of the trash bin, and the first hook and loop fastener may be attached to the second hook and loop fastener.

4. The bin bag dispenser of claim 1, wherein the plurality of receivers is in the form of plurality of arms that extend from the housing base of the dispenser housing.

5. The bin bag dispenser of claim 1, wherein the plurality of receivers is in the form of a plurality of slots formed in the housing base of the dispenser housing.

6. A bin bag dispenser for holding a trash bag roll on a bottom of a trash bin, the bin bag dispenser comprising:

a dispenser housing having a housing base and a housing wall that extends upwardly from the housing base to form a chamber for holding the trash bag roll;

a housing cover that fits over the dispenser housing to cover the chamber;

a dispensing mechanism in the housing cover for dispensing trash bags from the trash bag roll;

a fastener for removably fastening the dispenser housing to a bottom of the trash bin, the fastener having a plurality of attachment receivers formed in the dispenser housing, and a plurality of feet adapted to removably attach to the plurality of attachment receivers, each of the plurality of feet having a top end and a bottom end, and further having a means for securing each bottom end to the bottom of the trash bin; and wherein the plurality of feet each include a lower recessed portion and an upper recessed portion between the top end and the bottom end of each of the plurality of feet, each of the lower and upper recessed portions being shaped to receive and frictionally engage one of the attachment receivers so the plurality of feet are adjustably secured to the dispenser housing.

7. The bin bag dispenser of claim 6, further including a first hook and loop fastener mounted to the bottom end of each of the plurality of feet, and a second hook and loop fastener having an opposing adhesive side, such that the opposing adhesive side may be attached to the bottom of the trash bin, and the first hook and loop fastener may be attached to the second hook and loop fastener.

* * * * *